US008109823B2

(12) United States Patent
Aoki

(10) Patent No.: US 8,109,823 B2
(45) Date of Patent: Feb. 7, 2012

(54) GAMING MACHINE WITH WILD SYMBOL FEATURE

(75) Inventor: Dion K. Aoki, Henderson, NV (US)

(73) Assignee: WMS Gaming Inc., Waukegan, IL (US)

( * ) Notice: Subject to any disclaimer, the term of this patent is extended or adjusted under 35 U.S.C. 154(b) by 802 days.

(21) Appl. No.: 11/130,861

(22) Filed: May 17, 2005

(65) Prior Publication Data

US 2006/0264254 A1 Nov. 23, 2006

(51) Int. Cl.
*A63F 9/24* (2006.01)

(52) U.S. Cl. ..... 463/20; 463/16; 463/25

(58) Field of Classification Search ..... 463/16–22, 463/25; 273/143 R
See application file for complete search history.

(56) References Cited

U.S. PATENT DOCUMENTS

| | | | | |
|---|---|---|---|---|
| 5,431,408 | A | 7/1995 | Adams | |
| 5,722,891 | A * | 3/1998 | Inoue | 463/20 |
| 5,823,873 | A * | 10/1998 | Moody | 463/13 |
| 5,902,184 | A | 5/1999 | Bennett | |
| 6,089,977 | A | 7/2000 | Bennett | |
| 6,190,254 | B1 | 2/2001 | Bennett | |
| 6,234,897 | B1 * | 5/2001 | Frohm et al. | 463/20 |
| 6,251,013 | B1 * | 6/2001 | Bennett | 463/13 |
| 6,261,178 | B1 | 7/2001 | Bennett | |
| 6,394,902 | B1 * | 5/2002 | Glavich et al. | 463/20 |
| 6,439,993 | B1 | 8/2002 | O'Halloran | |
| 6,634,941 | B2 * | 10/2003 | Olive | 463/16 |
| 6,648,758 | B2 | 11/2003 | Bennett et al. | |
| 6,652,377 | B1 | 11/2003 | Moody | |
| 6,780,109 | B2 | 8/2004 | Kaminkow | |
| 6,866,583 | B2 | 3/2005 | Glavich et al. | |
| 7,137,888 | B2 * | 11/2006 | Glavich et al. | 463/20 |
| 2002/0082075 | A1 * | 6/2002 | Meyer | 463/20 |
| 2003/0013517 | A1 | 1/2003 | Bennett et al. | |
| 2003/0064772 | A1 * | 4/2003 | Tempest et al. | 463/16 |
| 2003/0203752 | A1 * | 10/2003 | Kaminkow et al. | 463/20 |
| 2004/0038730 | A1 * | 2/2004 | Suda | 463/20 |
| 2004/0048651 | A1 * | 3/2004 | Vorias et al. | 463/20 |
| 2004/0053676 | A1 * | 3/2004 | Rodgers | 463/20 |
| 2004/0072612 | A1 | 4/2004 | Rodgers et al. | |
| 2004/0137982 | A1 * | 7/2004 | Cuddy et al. | 463/20 |
| 2004/0259622 | A1 | 12/2004 | Duhamel | |
| 2005/0049035 | A1 | 3/2005 | Baerlocher et al. | |

OTHER PUBLICATIONS

"Brazil", *Product Sheet*, Aristocrat Leisure Industries,(1993), 1 pg.
"Double Header", *Product Sheet*, Williams Gaming Inc., 1 pg.
"Double Wild and Loose", *Product Sheet*, Williams Gaming Inc., 1 pg.
"Double XX Exposure", *Product Sheet*, Williams Gaming Inc., 1 pg.

(Continued)

*Primary Examiner* — Omkar Deodhar
(74) *Attorney, Agent, or Firm* — Nixon Peabody LLP

(57) ABSTRACT

A gaming machine for conducting a wagering game comprises one or more wild features having a wild symbol that matches or substitutes for other symbols used in the wagering game. The game may be a slot game utilizing a plurality of rotatable reels for displaying the symbols. The game includes a pay table defining standard awards for various winning combinations of the symbols. The game may duplicate a wild symbol included in a first combination of symbols into a corresponding position of a second combination of symbols to increase a probability that the second combination of symbols is a winning combination. If the wild symbol is used to complete one of the winning combinations on the pay table, the game may randomly select a modifier to enhance the standard award for that combination. Other wild features are also disclosed.

23 Claims, 21 Drawing Sheets

OTHER PUBLICATIONS

"Extra Point", *Product Sheet*, Williams Gaming Inc., 1 pg.
"Fat Tuesday™", *Product Sheet*, Williams Gaming Inc., 1 pg.
"Green Lizard", *Product Sheet*, Aristocrat Leisure Industries,(1994), 1 pg.
"Jackpot Stampede", *Product Sheet*, Williams Gaming Inc., 1 pg.
"Jitter Bug", *Product Sheet*, Williams Gaming Inc., 1 pg.
"Jungle Juice", *Product Sheet*, Aristocrat Leisure Industries,(1994), 1 pg.
"Kaleidoscopes™", *Product Sheet*, Williams Gaming Inc., 1 pg.
"Leapin' Lizards", *Product Sheet*, Williams Gaming Inc., 1 pg.
"Lucky Ladies", *Product Sheet*, Williams Gaming Inc., 1 pg.
"Magic Lamp", *Product Sheet*, Williams Gaming Inc.,(1999), 1 pg.
"Mega Multiplier™", *Product Sheet*, Williams Gaming Inc.,(1999), 1 pg.
"Mega Multiplier 125™", *Product Sheet*, Williams Gaming Inc. ,(1999), 1 pg.
"Parrots of the Caribbean", *Product Sheet*, Williams Gaming Inc., 1 pg.
"Pharoah's Fortune", *Product Sheet*, Williams Gaming Inc.,(1999), 1 pg.
"Riverbelle 21™", *Product Sheet*, Williams Gaming Inc.,(1999), 1 pg.
"Shootin' Stars", *Product Sheet*, Williams Gamin. Inc., 1 pg.
"Top Cat Deluxe™", *Product Sheet*, Williams Gaming Inc., (1999), 1 pg.
"Triple Bonus", *Product Sheet*, Williams Gaming Inc., 1 pg.
"Triple Treat", *Product Sheet*, Williams Gaming Inc., 1 pg.
"Wild and Loose", *Product Sheet*, Williams Gaming Inc., 1 pg.
"X Factor", *Product Sheet*, Williams Gaming Inc.,(1999), 1 pg.

* cited by examiner

GAMING MACHINE WITH WILD SYMBOL FEATURE

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming machine having a wild symbol feature.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to one aspect of the present invention, a gaming machine for conducting a wagering game comprises one or more wild features having a wild symbol that matches or substitutes for other symbols used in the wagering game. The game may be a slot game utilizing a plurality of rotatable reels for displaying the symbols. The game includes a pay table defining standard awards for various winning combinations of the symbols. The game may duplicate a wild symbol included in a first combination of symbols into a corresponding position of a second combination of symbols to increase a probability that the second combination of symbols is a winning combination. If the wild symbol is used to complete one of the winning combinations on the pay table, the game may randomly select a modifier to enhance the standard award for that combination. Other wild features are also disclosed.

Additional aspects of the invention will be apparent to those of ordinary skill in the art in view of the detailed description of various embodiments, which is made with reference to the drawings, a brief description of which is provided below.

DETAILED DESCRIPTION

Figure 1:
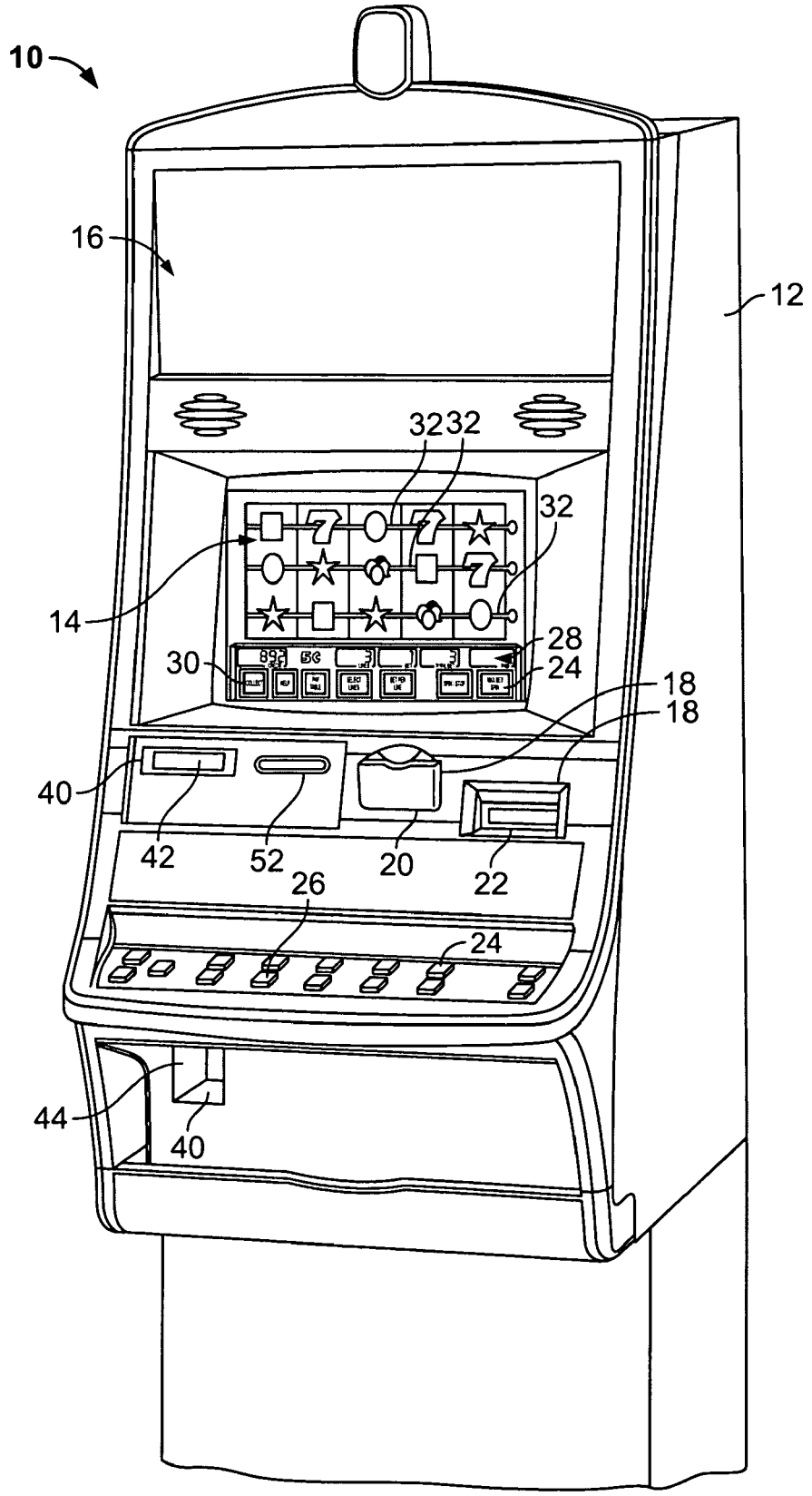
FIG. 1 is a perspective view of a gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. Alternatively, the primary display 14 of the gaming machine 10 may include a number of mechanical reels to display the outcome in visual associated to at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
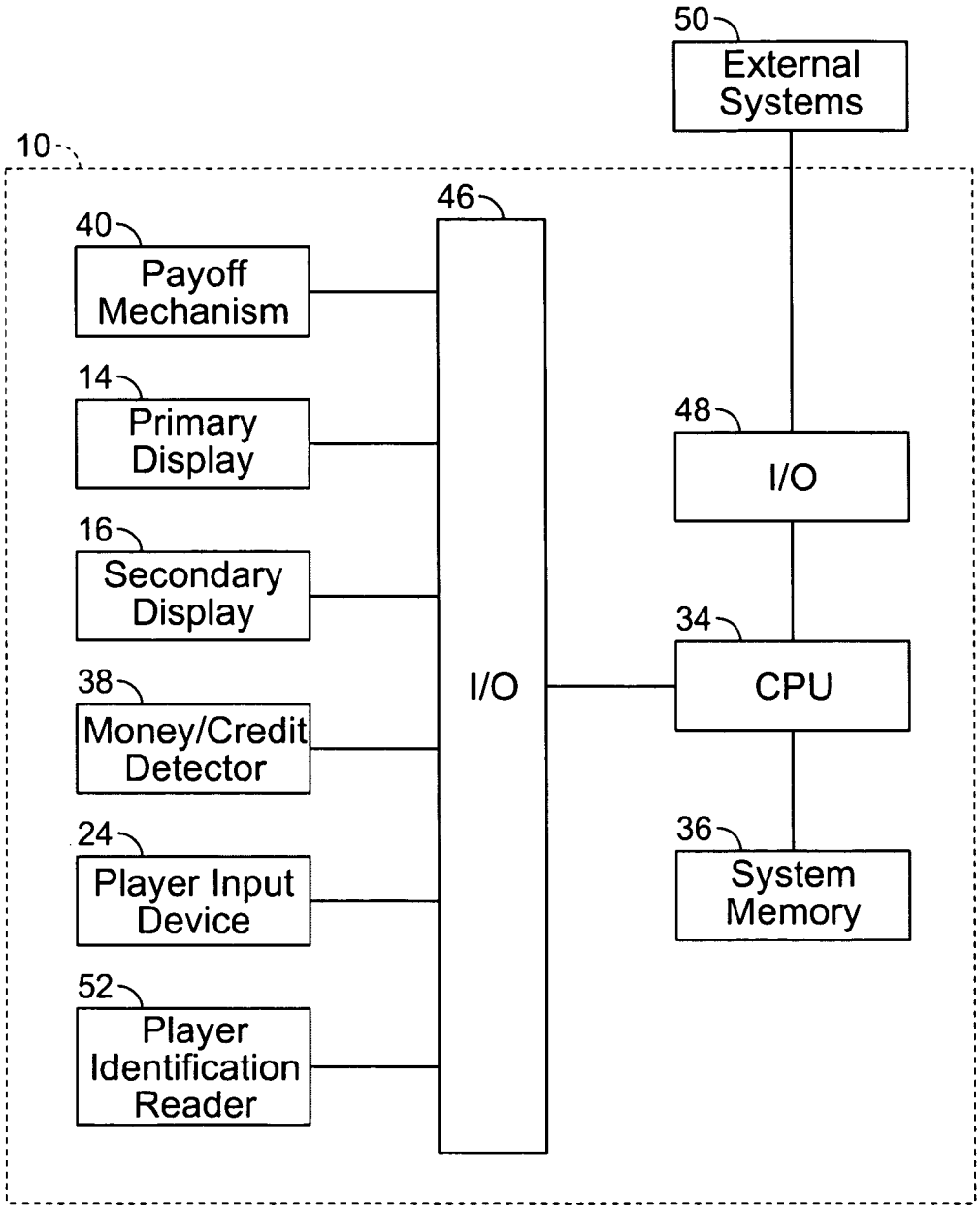
FIG. 2 is a block diagram of a control system suitable for operating the gaming machine.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

Turning now to the remaining figures, there are shown a number of wagering games with different wild features. In the figures, like reference numerals are used to identify analogous, but not necessarily identical, components.

Figure 3A:
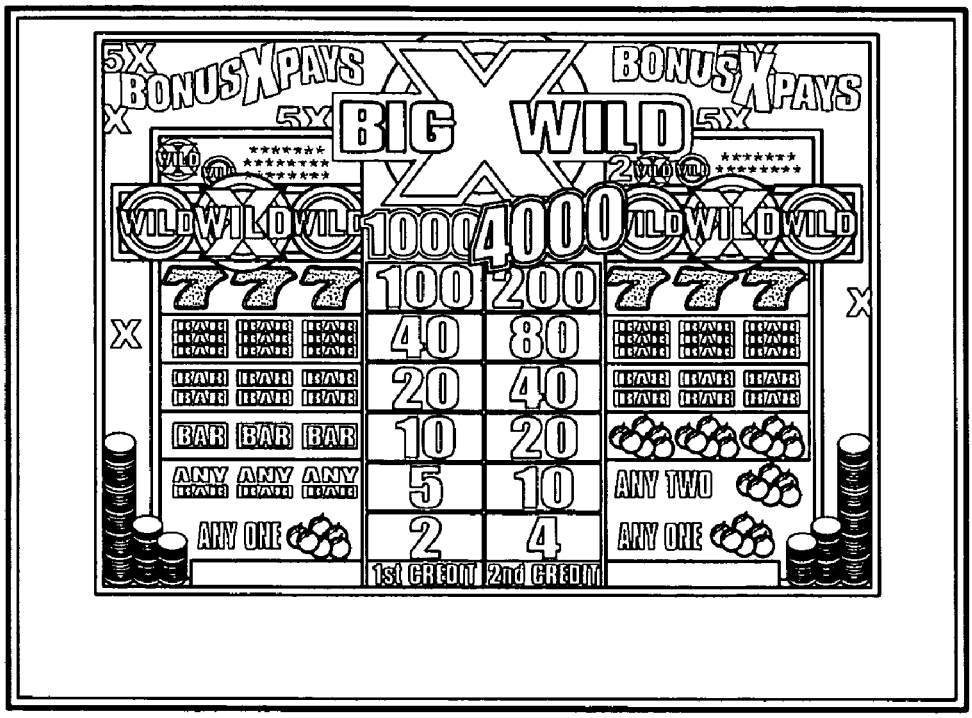
FIGS. 3*a* through 3*e* are display images associated with a "Big X" wagering game that may be conducted on the gaming machine.
Figure 3B:
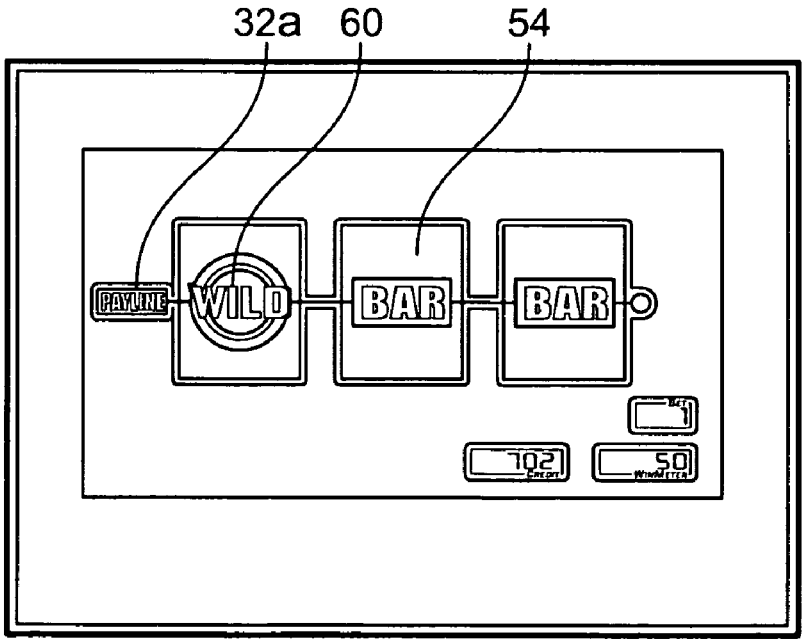
Figure 3D:
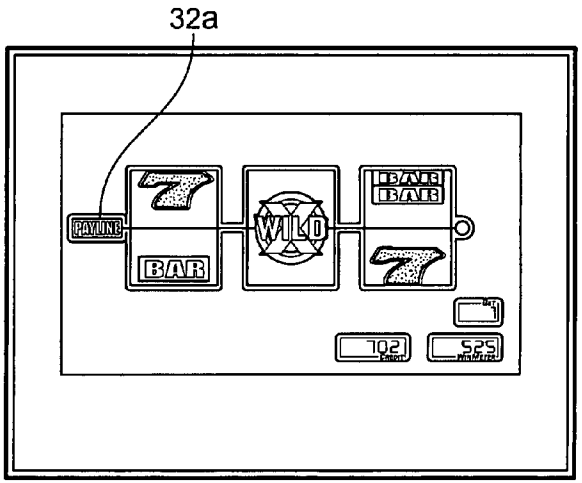
Figure 3C:
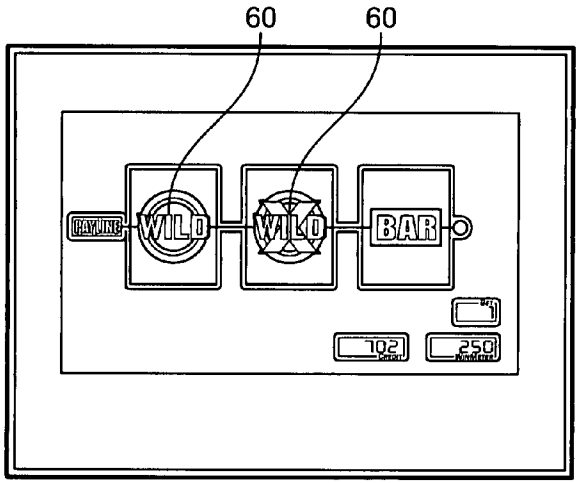
Figure 3E:
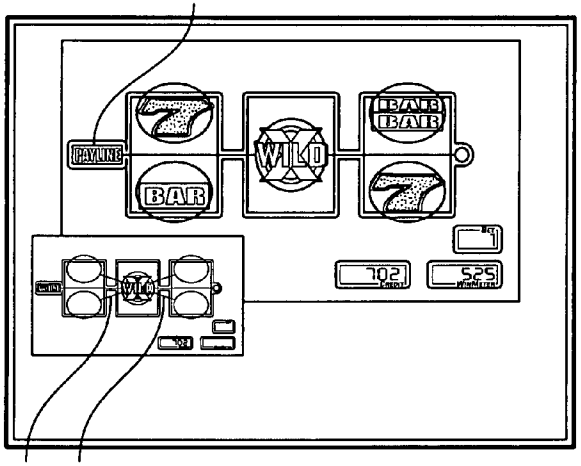

Referring to FIGS. 3*a* through 3*e*, a gaming machine conducts a wagering game called "Big X Wild" in accordance with an embodiment of the present invention. FIG. 3*a* depicts the reel symbols and pay table for the game. FIG. 3*b* depicts a plurality of symbol-bearing reels 54 that may be mechanical or simulated in video. One of the reel symbols is a WILD symbol 60 that matches or substitutes for all other reel symbols to complete a winning combination along a payline 32*a*. When one WILD symbol 60 completes a winning combination, the WILD symbol 60 multiplies the standard payout for that combination by 5X. When two WILD symbols 60 complete a winning combination, the WILD symbols 60 multiply the standard payout for that combination by 25X. Thus, in FIG. 3*b* the WILD symbol 60 multiplies the standard payout of 10 credits for a winning combination of three BAR symbols by 5X to yield a total payout of 50 credits. In FIG. 3*c* the two WILD symbols 60 multiply the standard payout of 10 credits for a winning combination of three BAR symbols by 25X to yield a total payout of 250 credits. In an alternative embodiment, the WILD symbol 60 may multiply the standard payout by a different value, such as 2X, 3X, 7X, or 10X. Referring to FIG. 3*d*, a "Big X Wild" feature is triggered by the combination of a BLANK symbol on the left reel, a WILD symbol 60 on the center reel, and a BLANK symbol on the right reel along the payline 32*a*. Referring to FIG. 3*e*, this symbol combination enables extra criss-cross (X) or diagonal paylines 32*b* and 32*c*, and the player is awarded for any winning combinations, i.e. combinations on the pay table in FIG. 3*a*, appearing on these enabled paylines. In the illustrated example, the player is awarded five times the sum of (i) the standard payout of 100 credits for a winning combination of three 7 symbols and (ii) the standard payout of 5 credits for a winning combination of three non-matching BAR symbols, i.e. ANY BAR pay.

Figure 4A:
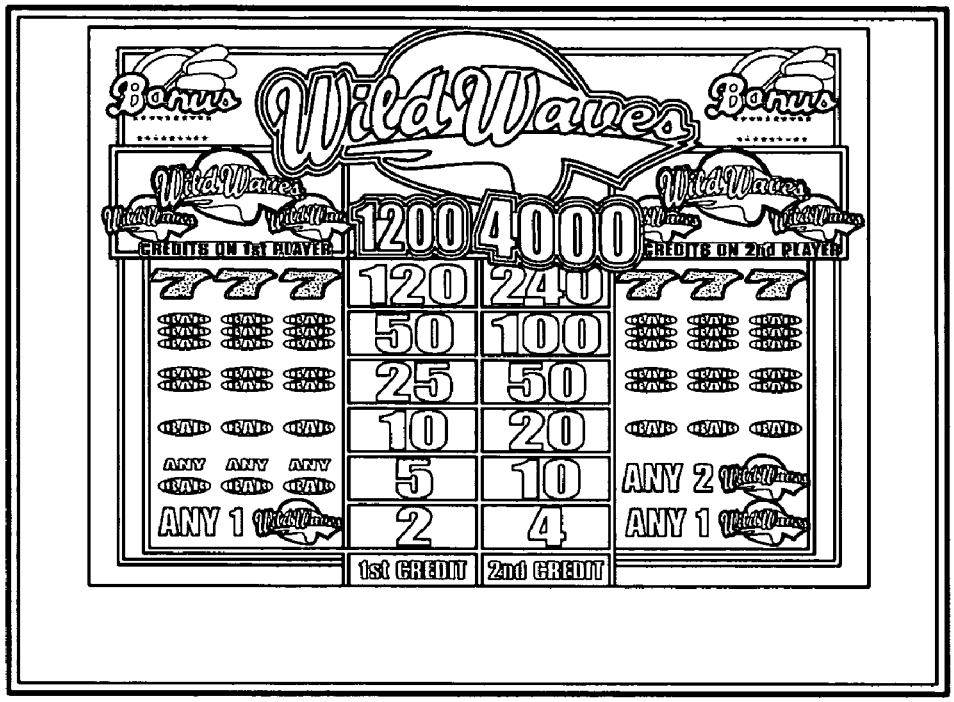
FIGS. 4*a* through 4*f* are display images associated with a "Wild Waves" wagering game that may be conducted on the gaming machine.
Figure 4B:
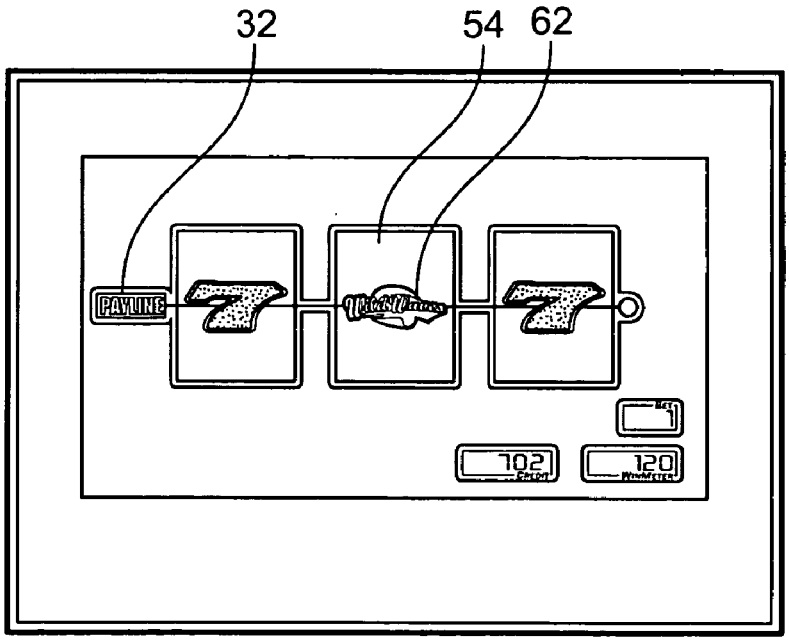
Figure 4D:
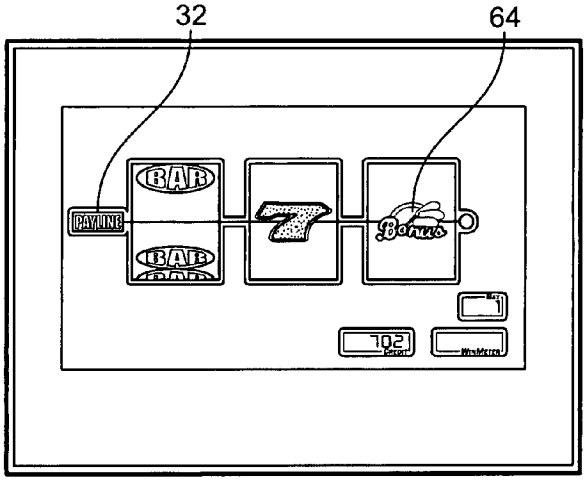
Figure 4C:
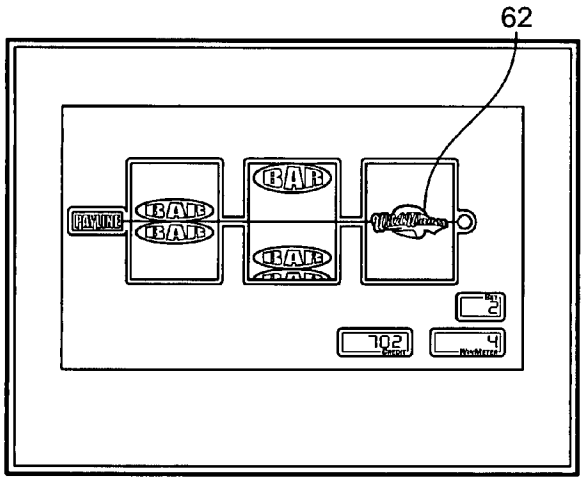

Referring to FIGS. 4*a* through 4*f*, a gaming machine conducts a wagering game called "Wild Waves" in accordance with another embodiment of the present invention. FIG. 4*a* depicts the reel symbols and pay table for the game. FIG. 4*b* depicts a plurality of symbol-bearing reels 54 that may be mechanical or simulated in video. One of the reel symbols is a WILD WAVES symbol 62 that matches or substitutes for all other reel symbols to complete a winning combination along a payline 32. In the illustrated example, the WILD WAVES symbol 62 completes a winning combination of three SEVEN symbols to yield a payout of 120 credits according to the pay table in FIG. 4*a*. Referring to FIG. 4*c*, the WILD WAVES symbol 62 also produces a payout when one or two WILD WAVES symbols 62 land along the payline 32 without completing a winning combination of other reel symbols. In the illustrated example, one WILD WAVES symbol 62 yields a payout of 2 credits multiplied by the line bet.

Figure 4F:
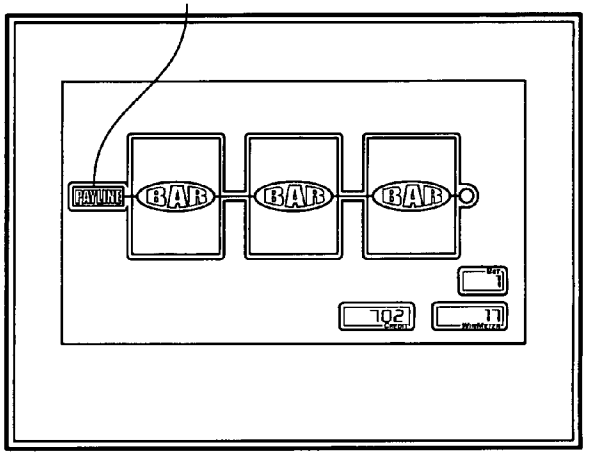
Figure 4E:
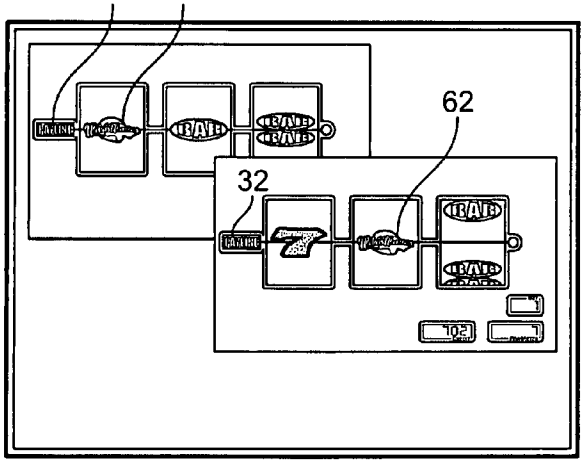

Referring to FIG. 4*d*, a spin-to-win "Wild Waves" feature is triggered by the appearance of a BONUS symbol 64 on the right reel along the payline 32. Referring to FIGS. 4*e* and 4*f*, the reels then repeatedly spin and stop until a winning combination lands along the payline 32. The player is awarded a payout for that winning combination according to the pay table in FIG. 4*a*. If the winning combination contains the WILD WAVES symbol 62, the player is awarded the payout for that combination, and the reels again repeatedly spin and stop until another winning combination lands along the payline 32. In the illustrated example, the "Wild Waves" feature results in a total bonus of 17 credits, which is the sum of (i) a first spin-to-win yielding a payout of 5 credits for an ANY BAR win completed with a WILD WAVES symbol 62, (ii) a second spin-to-win triggered by the first spin-to-win and yielding a payout of 2 credits for one WILD WAVES symbol 62, and (iii) a third and final spin-to-win triggered by the second spin-to-win and yielding a payout of 10 credits for a single BAR win.

Figure 5A:
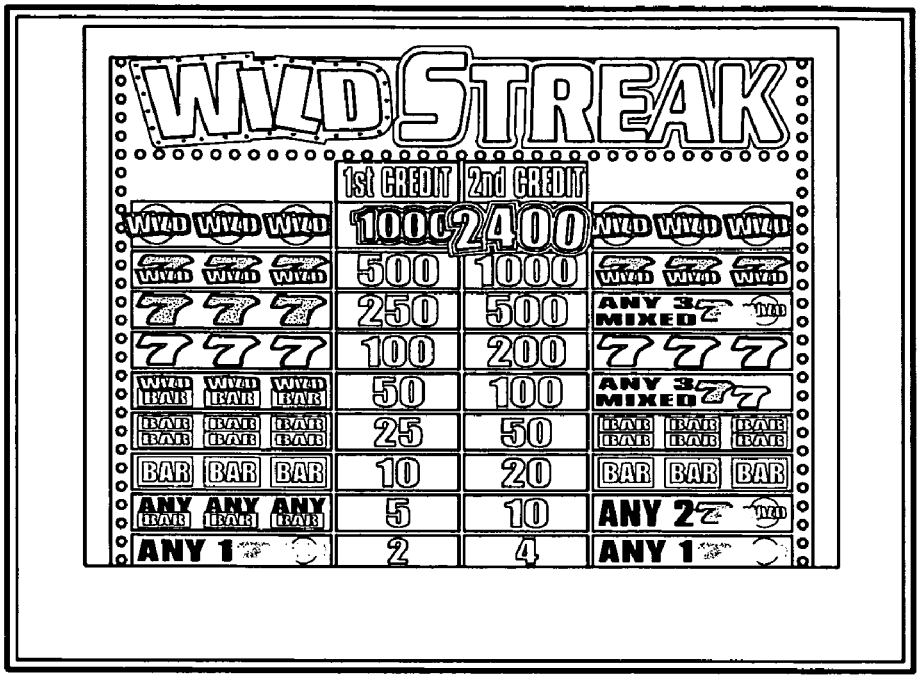
FIGS. 5*a* through 5*i* are display images associated with a "Wild Streak" wagering game that may be conducted on the gaming machine.
Figure 5B:
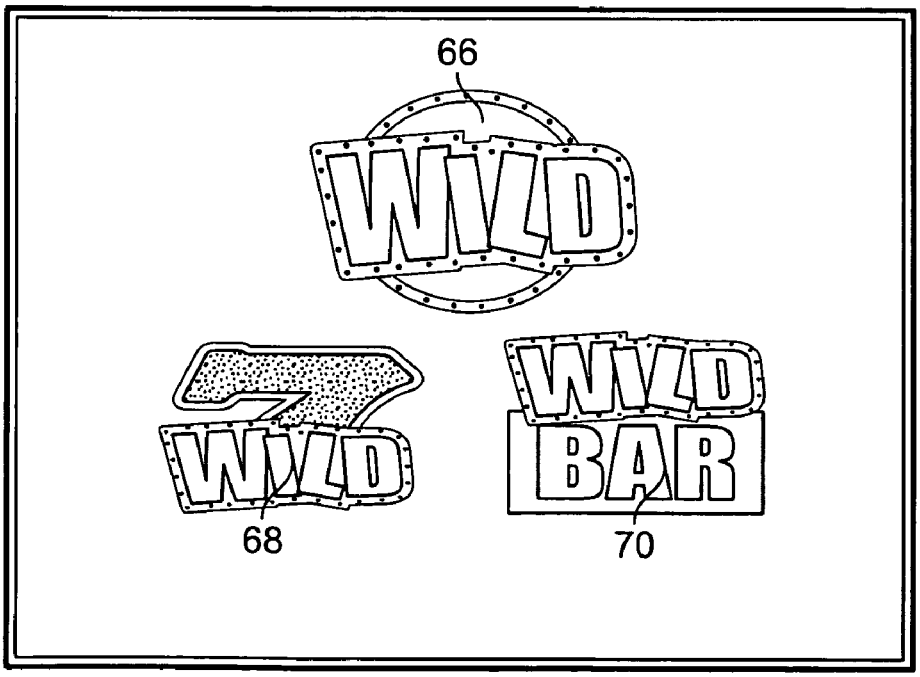
Figure 5C:
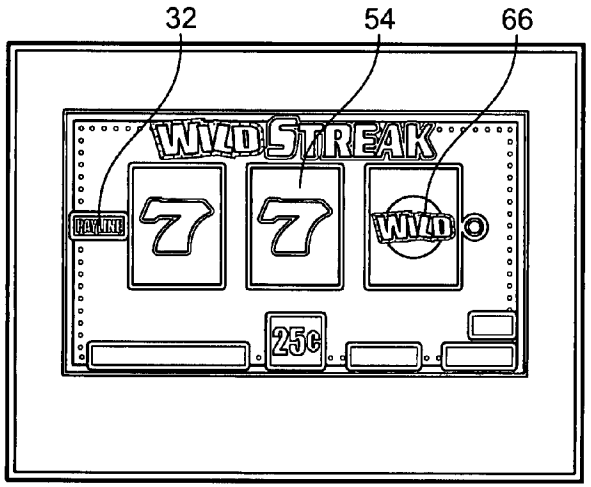
Figure 5D:
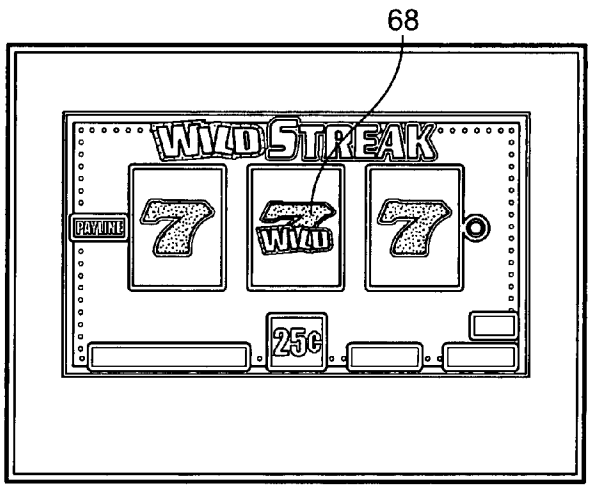
Figure 5E:
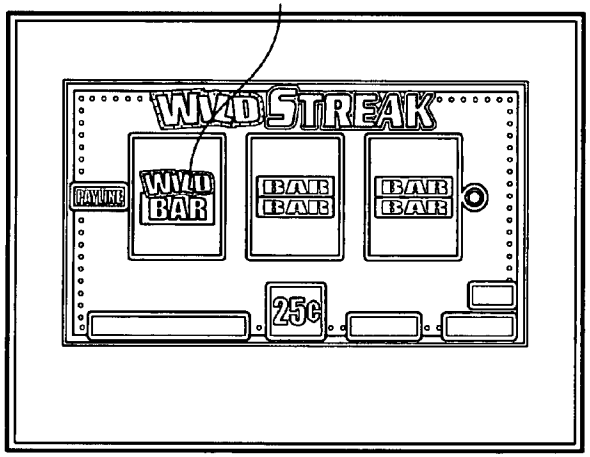

Referring to FIGS. 5*a* through 5*i*, a gaming machine conducts a wagering game called "Wild Streak" in accordance with another embodiment of the present invention. FIG. 5*a* depicts the reel symbols and pay table for the game. FIG. 5*b* depicts three wild symbols for the game, namely a WILD symbol 66, a WILD 7 symbol 68, and a WILD BAR symbol 70. FIG. 5*c* depicts a plurality of symbol-bearing reels 54 that may be mechanical or simulated in video. The wild symbols match or substitute for all other reel symbols to complete any winning combination along a payline 32. More specifically, the WILD symbol 66 doubles the standard payout of any winning combination that it completes. In the example in FIG. 5*c*, the WILD symbol 66 doubles the WHITE SEVENS payout. The WILD 7 symbol 68 doubles the standard payout of any winning SEVENS combination that it completes. In the example in FIG. 5*d*, the WILD 7 symbol 68 doubles the PURPLE SEVENS payout. The WILD BAR symbol 70 doubles the standard payout of any winning BAR combination that it completes. In the example in FIG. 5*e*, the WILD BAR symbol 70 doubles the DOUBLE BAR payout.

Figure 5F:
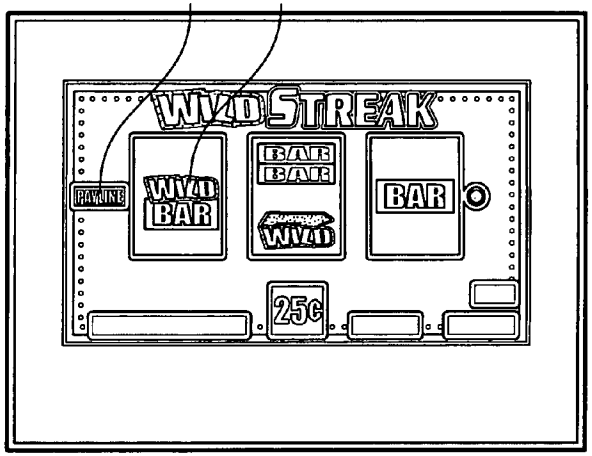
Figure 5H:
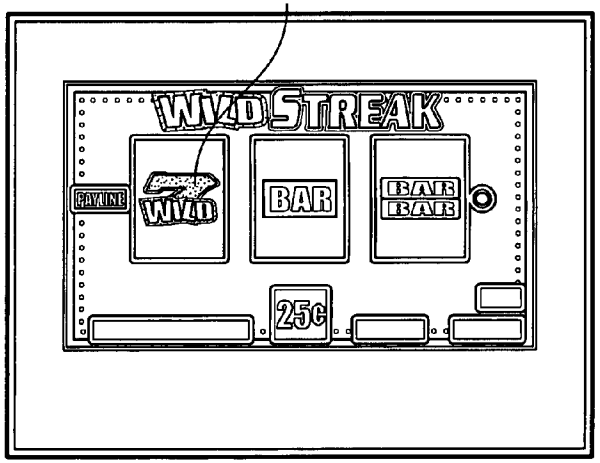
Figure 5G:
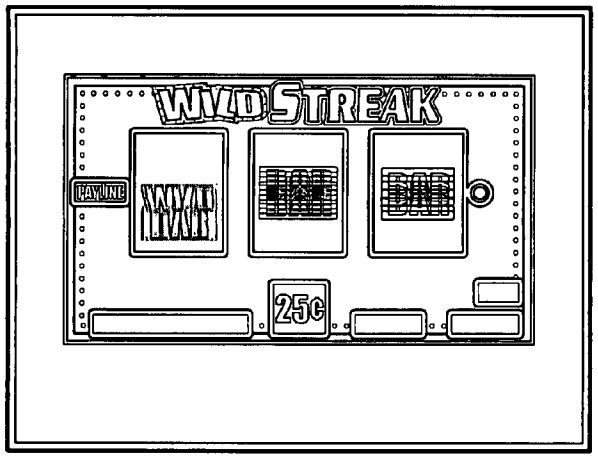
Figure 5I:
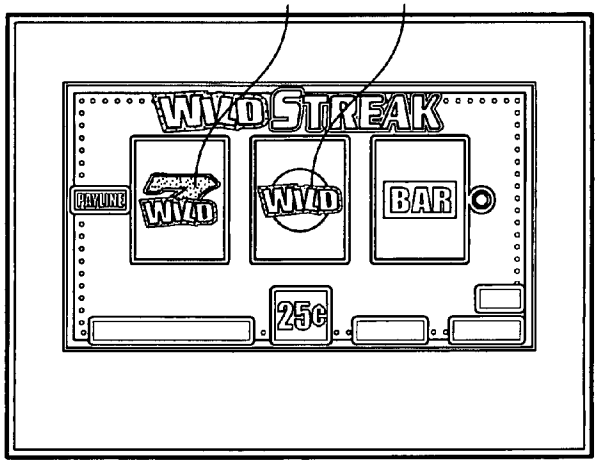

Referring to FIG. 5*f*, a "Wild Streak" feature is triggered by the appearance of any of the wild symbols 66, 68, or 70 along the payline 32 without completing a winning combination of other reel symbols. The player is first awarded a payout of 2 credits (multiplied by the line bet) for one wild. In the example in FIG. 5*f*, the WILD BAR symbol 70 on the left reel triggers the "Wild Streak" feature. Referring to FIGS. 5*g*, 5*h*, and 5*i*, the reels repeatedly respin and stop up to seven times. The number of respins is randomly determined. For each respin, the reel that contained the wild symbol to trigger the "Wild Streak" feature randomly respins to the same or a different wild symbol 66, 68, or 70, while the other two reels randomly respin to any of the reel symbols. In the example in FIG. 5*h*, the left reel that contained the WILD BAR symbol 70 is randomly spun to the WILD 7 symbol 68, while the other two reels are randomly respun to BAR and DOUBLE BAR symbols, thereby creating an ANY BAR win worth 5 credits. Referring to FIG. 5*i*, if a second wild symbol lands along the payline 32 during the "Wild Streak" feature, the game awards an additional one to seven respins where the two reels that contained wild symbols randomly respin to the same or a different wild symbol 66, 68, or 70, while the other reel randomly respins to any of the reel symbols.

Figure 6A:
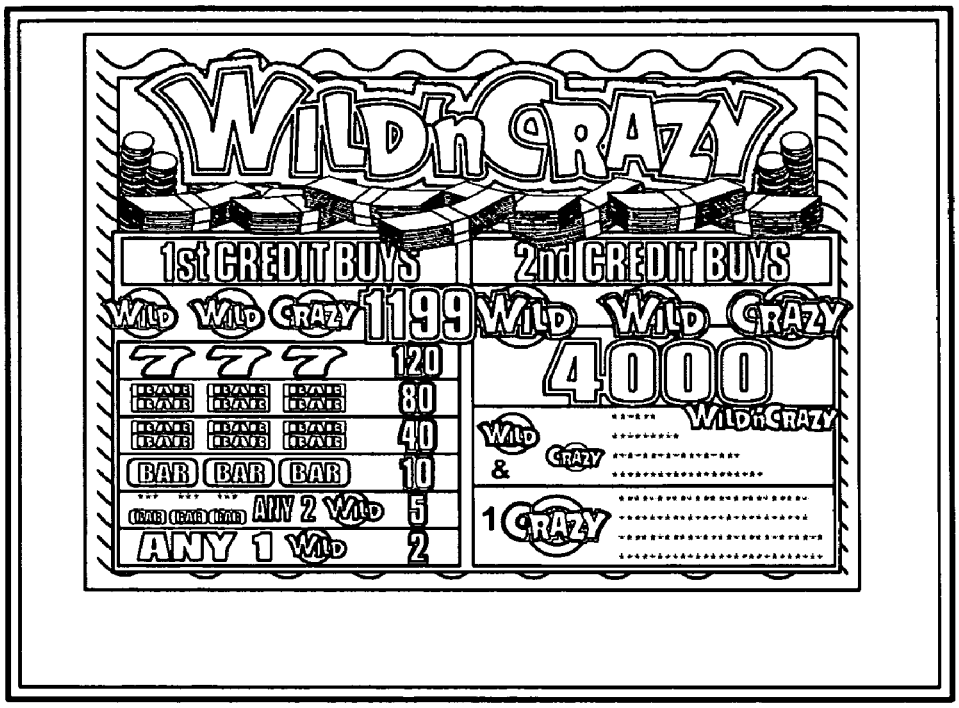
FIGS. 6*a* through 6*f* are display images associated with a "Wild 'n Crazy" wagering game that may be conducted on the gaming machine.
Figure 6B:
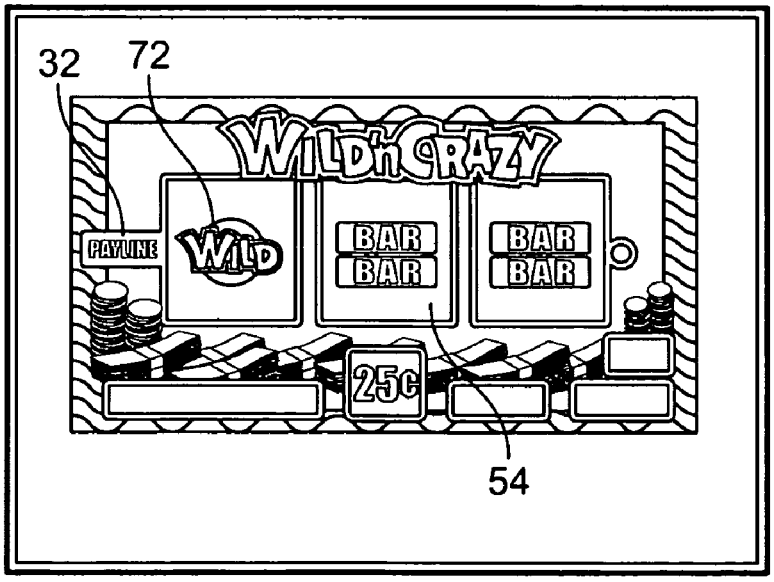
Figure 6D:
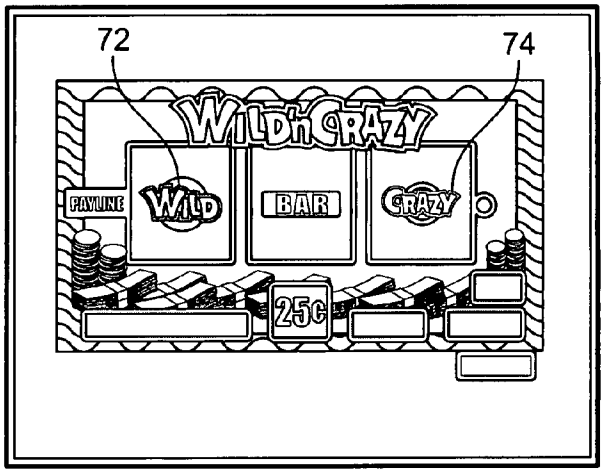
Figure 6C:
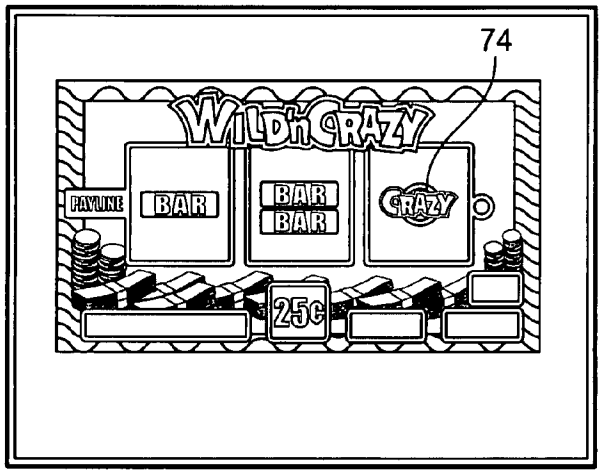

Referring to FIGS. 6*a* through 6*f*, a gaming machine conducts a wagering game called "Wild 'n Crazy" in accordance with another embodiment of the present invention. FIG. 6*a* depicts the reel symbols and pay table for the game. The first credit wagered makes the player eligible for the payouts on the left side of the pay table, while the second credit wagered makes the player eligible for a "Crazy" feature and a "Wild 'n Crazy" feature. FIGS. 6*b* and 6*c* depict a plurality of symbol-bearing reels 54 that may be mechanical or simulated in video. Two of the reel symbols are wild, namely a WILD symbol 72 and a CRAZY symbol 74, and therefore match or substitute for all other reel symbols to complete a winning combination along a payline 32. In the example in FIG. 6*b*, the WILD symbol 72 completes a winning combination of three DOUBLE BAR symbols. In the example in FIG. 6*c*, the CRAZY symbol 74 completes an ANY BAR win. If the CRAZY symbol 74 completes a winning combination when the player has placed a maximum wager, i.e. max bet, the "Crazy" feature is triggered. In the "Crazy" feature, the CRAZY symbol 74 locks in place and the other two reels repeatedly respin to, and pay for, the same winning combination up to seven times.

Figure 6F:
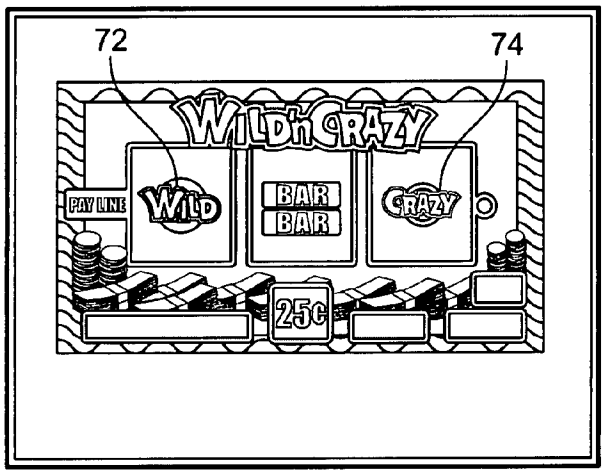
Figure 6E:
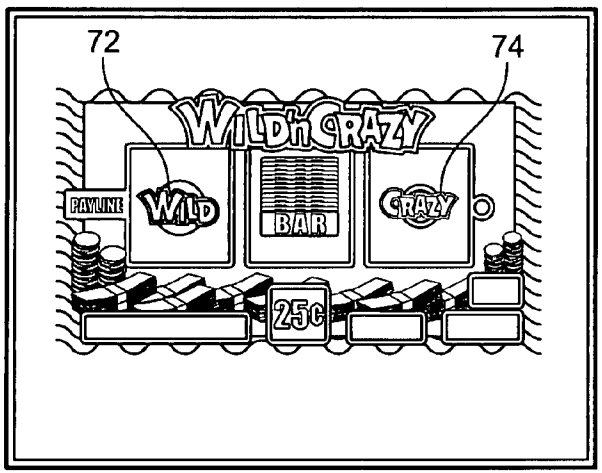

Referring to FIGS. 6*d*, 6*e*, and 6*f*, if the WILD symbol 72 and the CRAZY symbol 74 complete a winning combination when the player has placed a maximum wager, the "Wild "n Crazy" feature is triggered. In the "Wild ' n Crazy" feature, both the WILD symbol 72 and the CRAZY symbol 74 lock in place and the remaining reel repeatedly respins to, and pays for, the same winning combination or a higher paying combination on the pay table up to seven times. The number of respins is randomly determined. In the illustrated example, the WILD and CRAZY symbols 72 and 74 first complete a single BAR win in FIG. 6*d* and then complete a DOUBLE BAR win in FIG. 6*f* upon respinning the center reel. After this first respin, up to six more respins may occur.

Figure 7A:
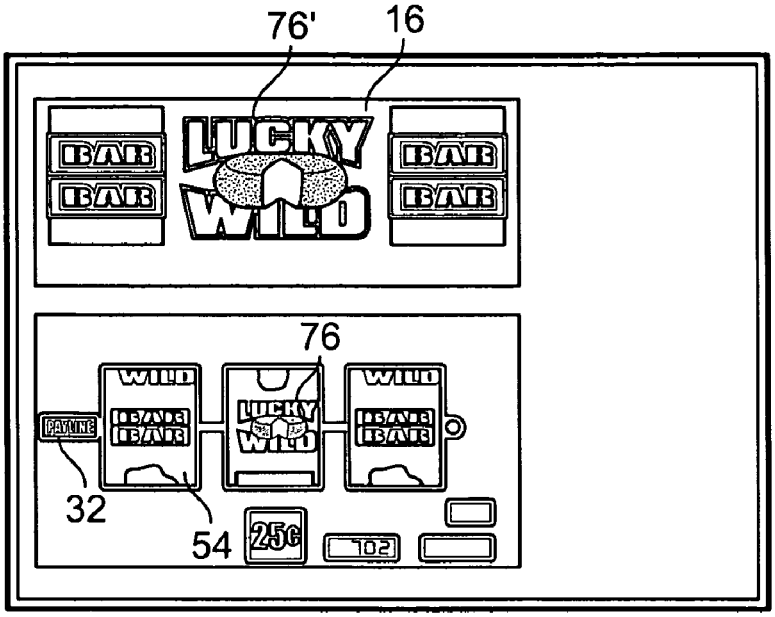
FIGS. 7*a* through 7*g* are display images associated with a "Say Cheese" wagering game that may be conducted on the gaming machine.
Figure 7B:
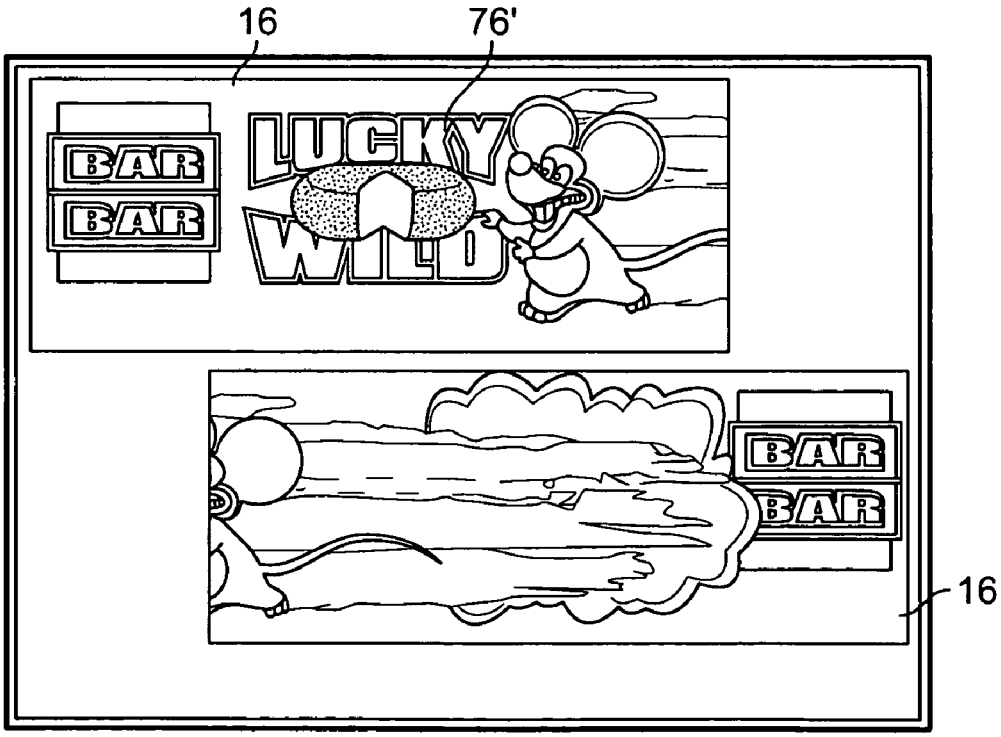
Figure 7C:
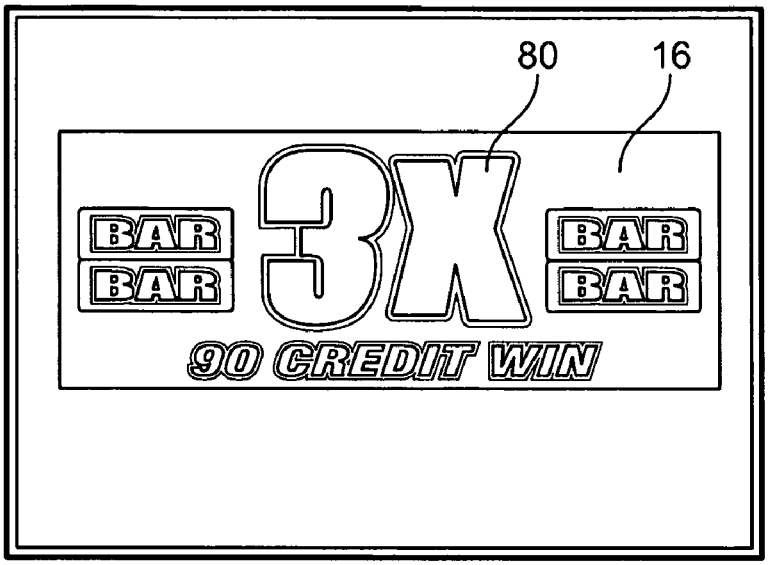
Figure 7D:
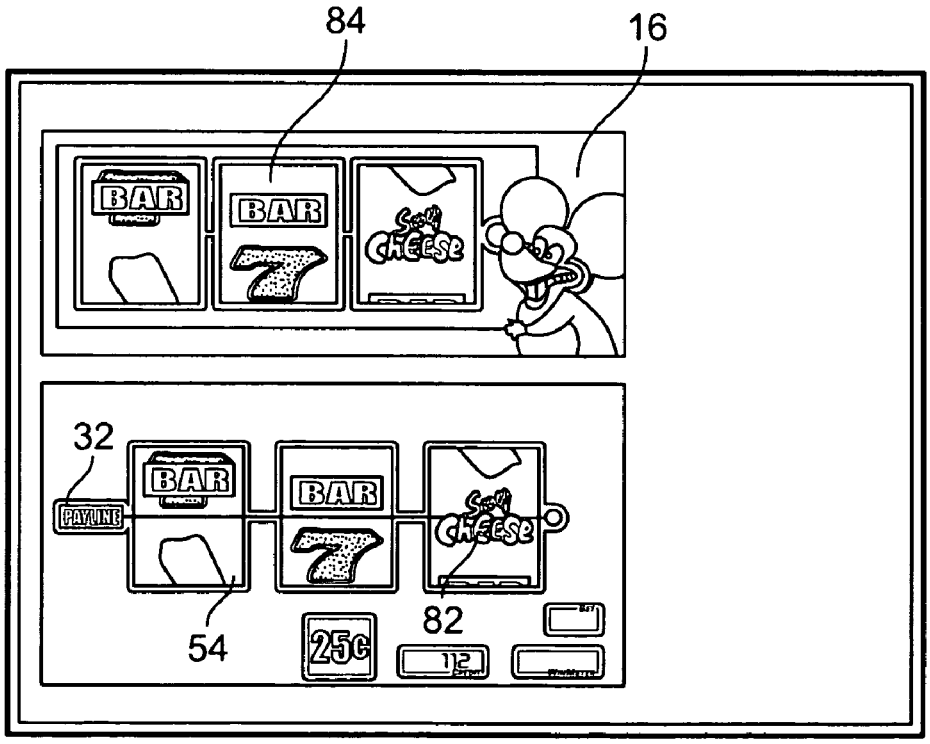
Figure 7F:
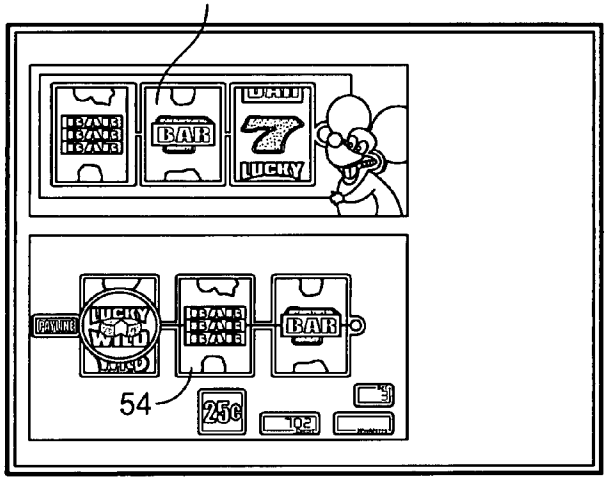
Figure 7E:
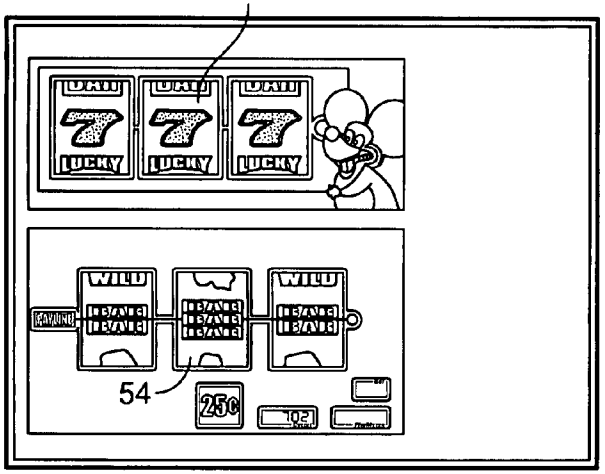
Figure 7G:
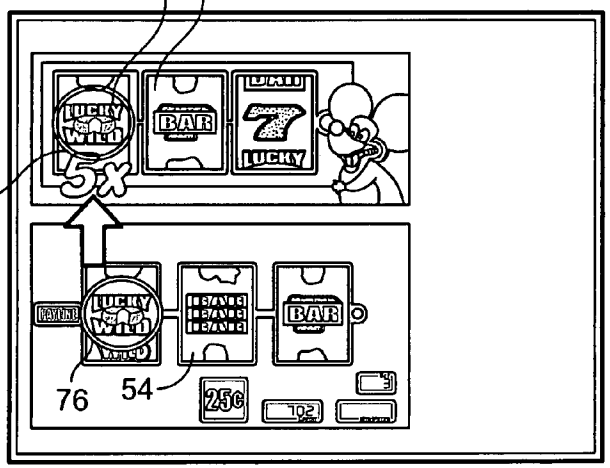

Referring to FIGS. 7*a* through 7*g*, a gaming machine conducts a wagering game called "Say Cheese" in accordance with another embodiment of the present invention. FIG. 7*a* depicts a plurality of symbol-bearing reels 54 that may be mechanical or simulated in video. One of the reel symbols is a LUCKY CHEESE WILD symbol 76 that matches or substitutes for all other reel symbols to complete a winning combination along a payline 32. In addition to the reels 54, the machine includes an upper video display 16 positioned above the reels 54. The upper display 16 may be implemented with a liquid crystal display (LCD), dot matrix, cathode ray tube (CRT), plasma, or other type of video display. When the LUCKY CHEESE WILD symbol 76 completes a winning combination along the payline 32, e.g. a DOUBLE BAR win, the winning combination is automatically duplicated on the upper display 16. Referring to FIGS. 7*b* and 7*c*, a mouse character then runs onto the display 16 and transforms the duplicated LUCKY CHEESE WILD symbol 76' to a random multiplier 80 from 2X to 10X. The selected multiplier, e.g. 3X in FIG. 7*c*, multiplies the standard payout for the winning combination.

Referring to FIGS. 7*d*, 7*e*, 7*f*, and 7*g*, a "Say Cheese" free spin feature is triggered by a SAY CHEESE symbol 82 on the right reel along the payline 32. The upper display 16 depicts a second set of reels 84 initially displaying the same reel symbols displayed on the lower set of reels 54. The player is then awarded five free spins on both the lower set of reels 54 and the upper set of reels 84. For each free spin, the game randomly determines the outcome for the lower set of reels 54 and randomly determines the outcome for the upper set of reels 84. These outcomes are separately determined. The player is awarded for a payout for any winning combinations resulting from each free spin. In the example in FIG. 7*e*, the player is awarded for an ANY BAR win on the lower set of reels 54 and a SEVENS win on the upper set of reels 84. If a free spin results in LUCKY CHEESE WILD symbol 76 in the center of any of the reels 54 or 84, the corresponding reel on the other set of reels automatically respins to the LUCKY CHEESE WILD symbol 76 and multiplies the standard payout for any winning combination on either set of reels by a random multiplier 80 from 2X to 10X. In the example in FIGS. 7*f* and 7*g*, the LUCKY CHEESE WILD symbol 76 lands in the center of the left reel of the lower set of reels 54, causing the corresponding left reel of the upper set of reels 84 to respin to the LUCKY CHEESE WILD symbol 76 as well. The player is awarded a mixed SEVENS payout on the upper set of reels 84, multiplied by 5X.

Figure 8A:
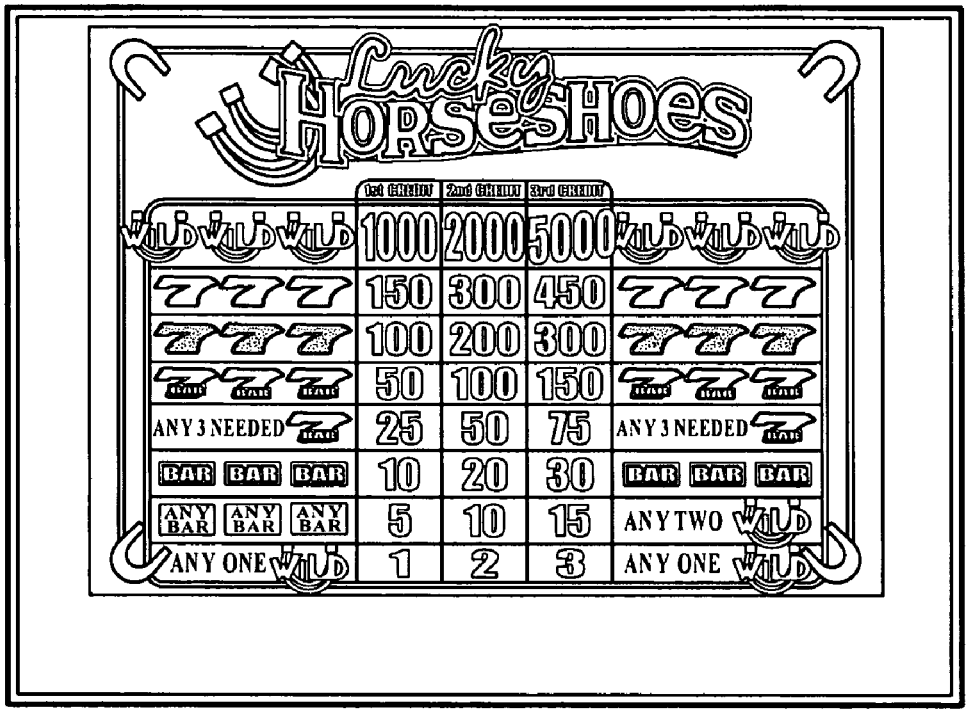
FIGS. 8*a* through 8*f* are display images associated with a "Lucky Horseshoes" wagering game that may be conducted on the gaming machine.
Figure 8B:
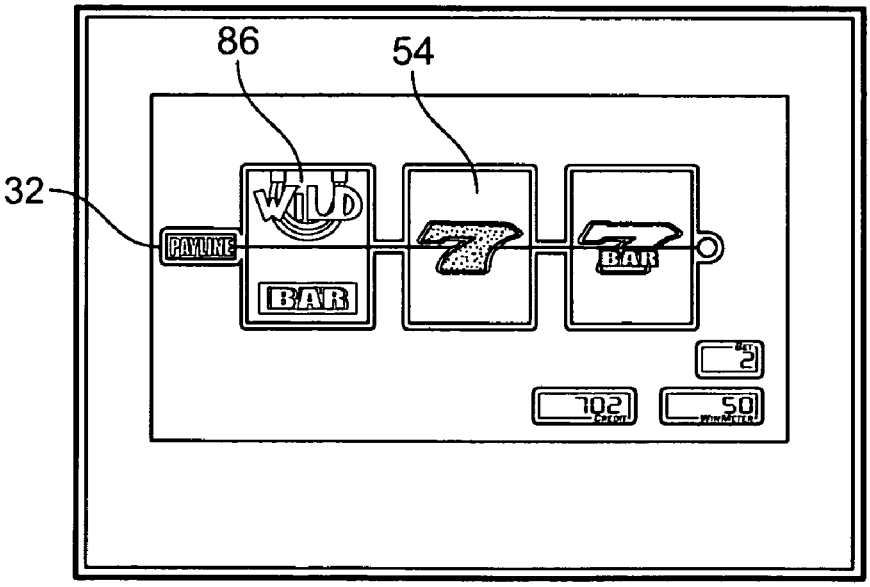
Figure 8D:
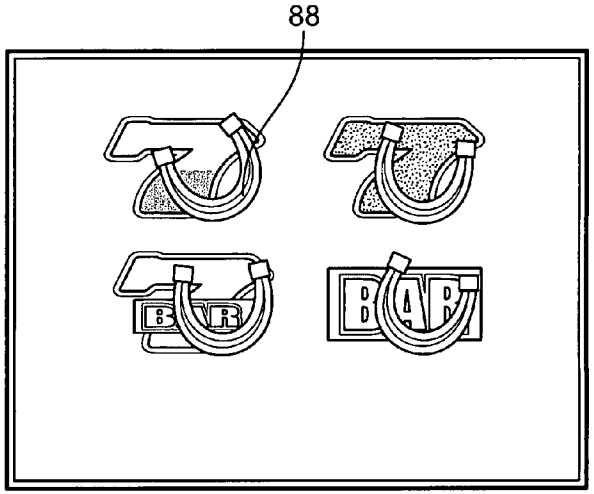
Figure 8C:
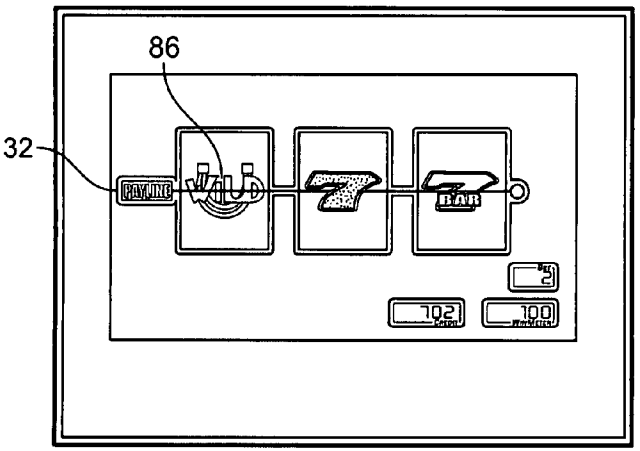

Referring to FIGS. 8*a* through 8*f*, a gaming machine conducts a wagering game called "Lucky Horseshoes" in accordance with another embodiment of the present invention. FIG. 8*a* depicts the reel symbols and pay table for the game. FIG. 8*b* depicts a plurality of symbol-bearing reels 54 that may be mechanical or simulated in video. One of the reel symbols is a WILD HORSESHOE symbol 86 that is wild for any other reel symbol when the WILD HORSESHOE symbol lands on or within one position of a payline 32. In the illustrated example, the WILD HORSESHOE symbol 86 completes a winning combination of mixed SEVENS to yield a standard payout of 50 credits on a 2 credit wager. Referring to FIG. 8*c*, when the WILD HORSESHOE symbol 86 lands on the payline 32 and completes a winning combination, it doubles the standard payout for that combination. In the example in FIG. 8*c*, the WILD HORSESHOE SYMBOL 86 again completes a winning combination of mixed SEVENS but this time yields a payout of 100 credits by doubling the standard payout of 50 credits on a 2 credit wager.

Figure 8F:
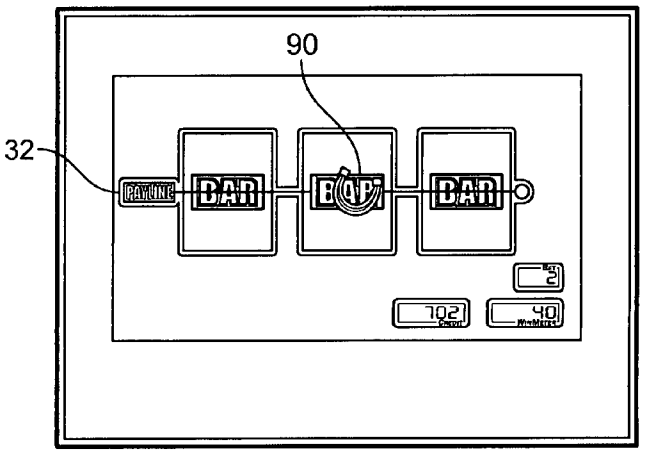
Figure 8E:
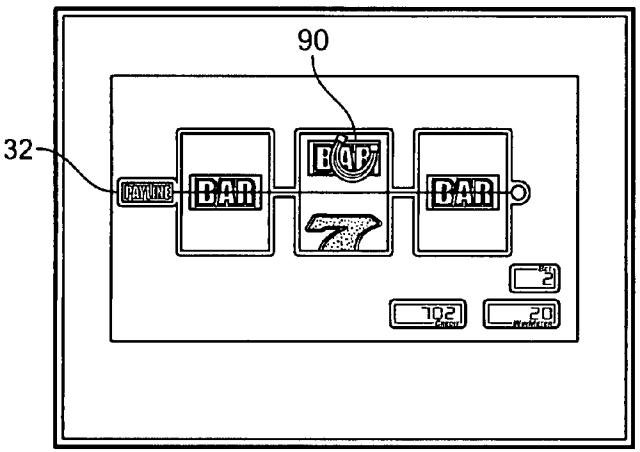

Referring to FIG. 8*d*, each reel symbol has both a standard version without a superimposed horseshoe and a special version with a superimposed horseshoe 88. Referring to FIGS. 8*e* and 8*f*, the horseshoe version of a symbol may be used to complete a winning combination for that symbol when the horseshoe version lands on or within one position of the payline 32. If it lands on the payline 32, the standard payout for that winning combination is doubled; otherwise it is not. In the example in FIG. 8*e*, the horseshoe BAR symbol 90 lands within one position of the payline 32 to complete a BAR win and yield a standard payout of 20 credits on a 2 credit wager. In the example in FIG. 8*f*, the horseshoe BAR symbol 90 lands on the payline 32 to complete a BAR win and double the standard payout.

Figure 9B:
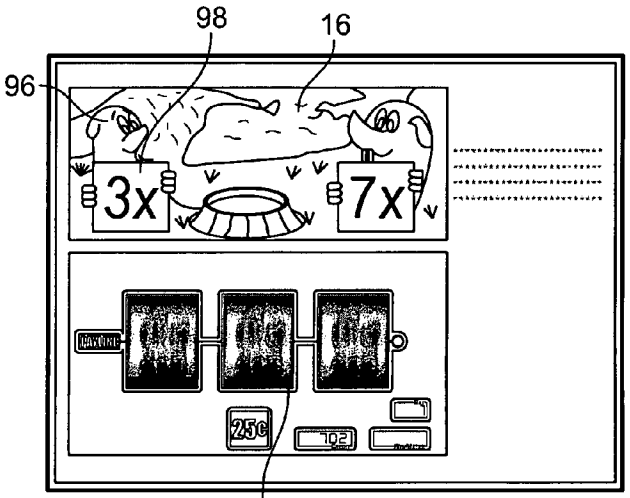
FIGS. 9*a* through 9*c* are display images associated with a "Whack-a-Winner" wagering game that may be conducted on the gaming machine.
Figure 9A:
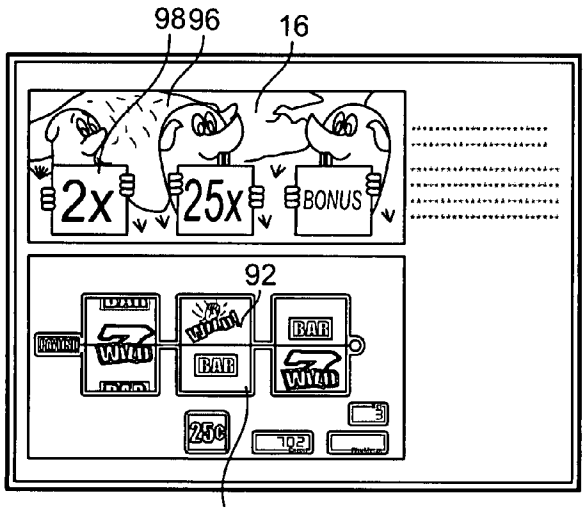
Figure 9C:
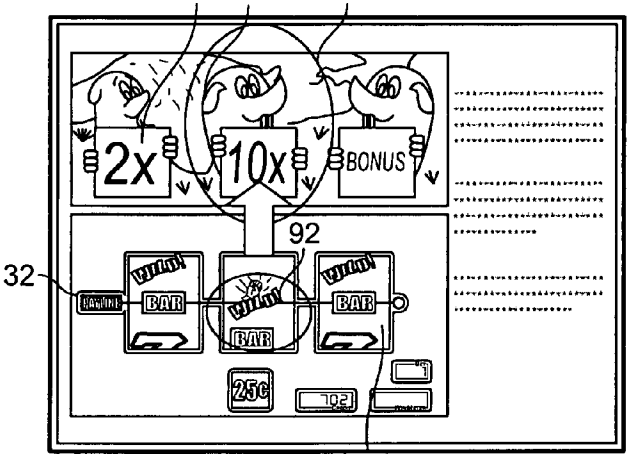

Referring to FIGS. 9*a* through 9*c*, a gaming machine conducts a wagering game called "Whack-a-Winner" in accordance with another embodiment of the present invention. FIG. 9*a* depicts a plurality of symbol-bearing reels 54 that may be mechanical or simulated in video. One of the reel symbols is a WILD MALLET symbol 92 that matches or substitutes for all other reel symbols to complete a winning combination along a payline 32. In addition to the reels 54, the machine includes an upper video display 16 positioned above the reels 54. The upper display 16 may be implemented with a liquid crystal display (LCD), dot matrix, cathode ray tube (CRT), plasma, or other type of video display. The upper display 16 depicts three moles and/or mole holes 96 corresponding to the respective three reels 54. Each mole 96 holds a bonus sign 98 featuring a modifier such as a multiplier ranging from 2X to 10X, a credit amount, a bonus trigger, or a change in symbol functionality. A change in symbol functionality may, for example, convert a standard line-pay reel symbol into a wild or a scatter pay symbol.

Referring to FIG. 9*b*, for each spin of the reels 54, the moles 96 randomly "pop" in and out of the holes carrying different bonus signs 98. Referring to FIG. 9*c*, if the WILD MALLET symbol 92 lands on the payline 32, the mole 96 that pops into the mole hole corresponding to the WILD MALLET symbol 92 is "whacked." The player is then awarded the standard payout for the winning combination appearing along the payline 32, modified by the modifier on the bonus sign carried by the whacked mole. In the illustrated example, the standard payout for a single BAR win is multiplied by 10X.

Figure 10A:
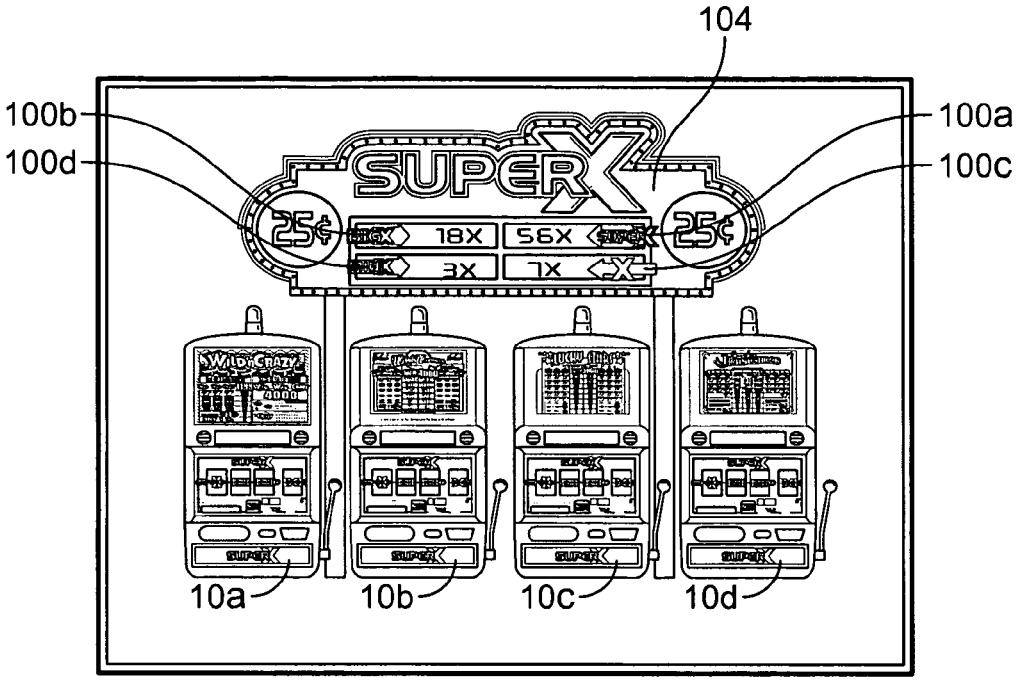
FIG. 10*a* is a diagrammatic representation of a system of linked gaming machines.

Referring to FIGS. 10*a* through 10*d*, a gaming system conducts a progressive multiplier feature called "Super X" in accordance with another embodiment of the present invention. Referring to FIG. 10*a*, the gaming system includes a plurality of linked gaming machines 10*a*, 10*b*, 10*c*, and 10*d*. The number of linked machines may be less or greater than the number illustrated, and may be in the same bank, in multiple banks, in the same casino, or in multiple casinos. Also, the machines may be of the same or different themes and of the same or different denominations. In the illustrated example, the gaming machines are of different themes and of the same denomination, e.g. 25 cents. The "Super X" feature includes a multi-level bonus progressive that may be added to the linked machines. The "Super X" feature may alternatively be added to a single, standalone gaming machine. When the "Super X" feature is applied to a bank of machines, above the bank is a sign 104 with four progressive multiplier meters: (i) a Super X multiplier 100*a* ranging from 25X and above, (ii) a Big X multiplier 100*b* ranging from 10X to 25X, (iii) an X multiplier 100*c* ranging from 5X to 10X, and (iv) a Mini X multiplier 100*d* ranging from 2X to 5X. As players play the machines, the progressive multiplier meters increment in value based on predetermined or random criteria. For example, each meter may increase based on a certain number of wager inputs or based on specific outcomes at the linked machines. Each meter may reset to its lowest value in response to that meter being awarded to one of the linked machines.

Figure 10B:
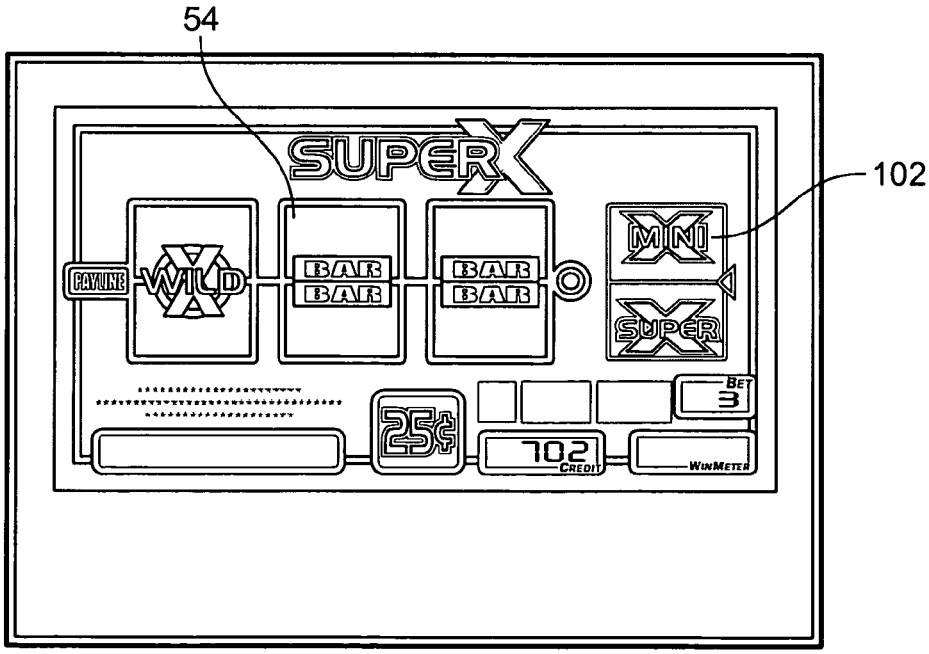
FIGS. 10*b* through 10*c* are display images associated with a "Super X" wagering game that may be conducted on the linked machines.
Figure 10C:
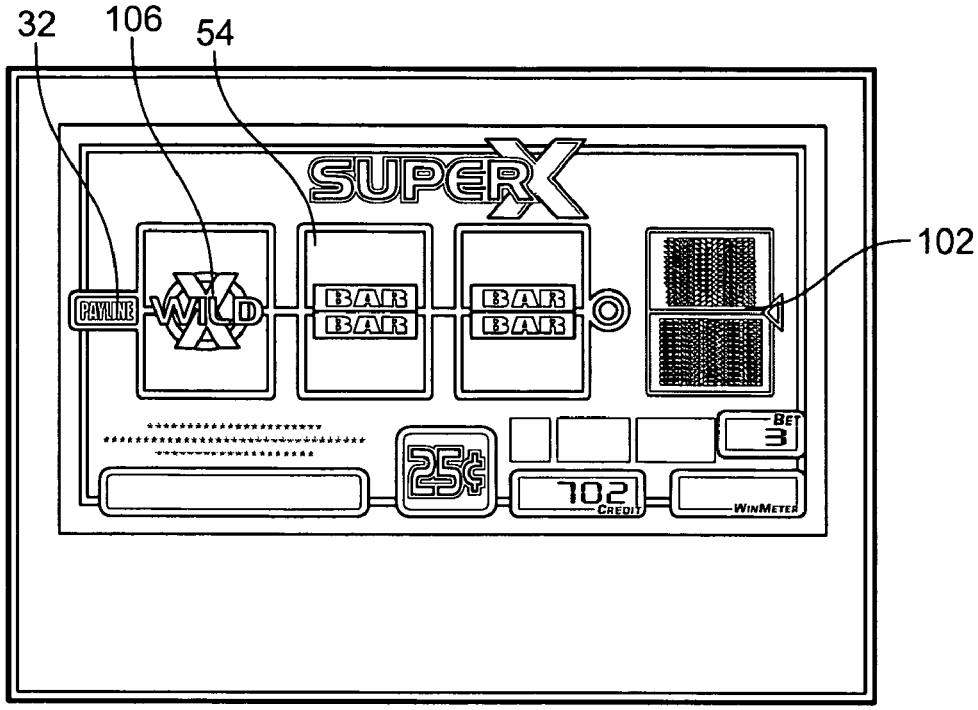
Figure 10D:
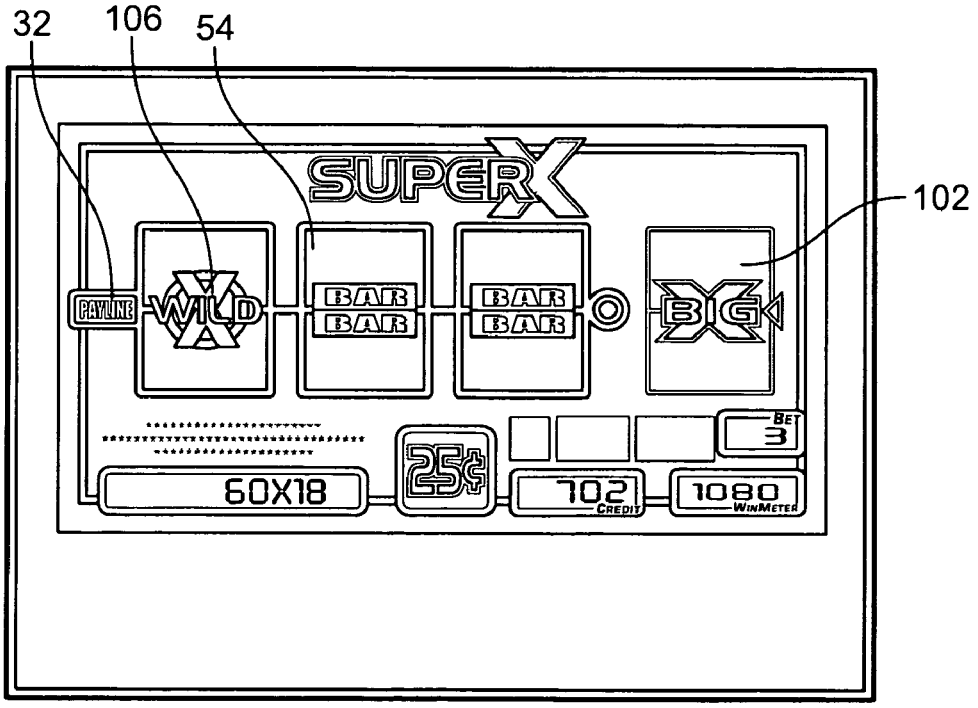

Referring to FIG. 10*b*, each machine includes a plurality of symbol-bearing main reels 54 and a special bonus reel 102 to the right of the main reels 54. The bonus reel 102 carries symbols representing each of the progressive levels. The reels 54 and 102 may be mechanical or simulated in video, and both the reels 54 and the reel 102 need not be implemented with the same type of display. One of the reel symbols is a WILD symbol 106 that matches or substitutes for all other reel symbols to complete a winning combination along a payline 32. Referring to FIGS. 10*c* and 10*d*, if the WILD symbol 106 is used to complete a winning combination along the payline 32 resulting from a spin of the reels 54, then the game automatically spins the bonus reel 102. The player is awarded the standard payout for the winning combination multiplied by the current value of the progressive multiplier identified by the bonus reel symbol that lands on the payline 32. In the illustrated example, the standard payout for a DOUBLE BAR win is multiplied by the current Big X multiplier 100*b*, i.e. 18X (see FIG. 10*a*). After the Big X multiplier 100*b* is applied to the DOUBLE BAR win, the Big X multiplier 100*b* is reset to 10X.

Figure 11A:
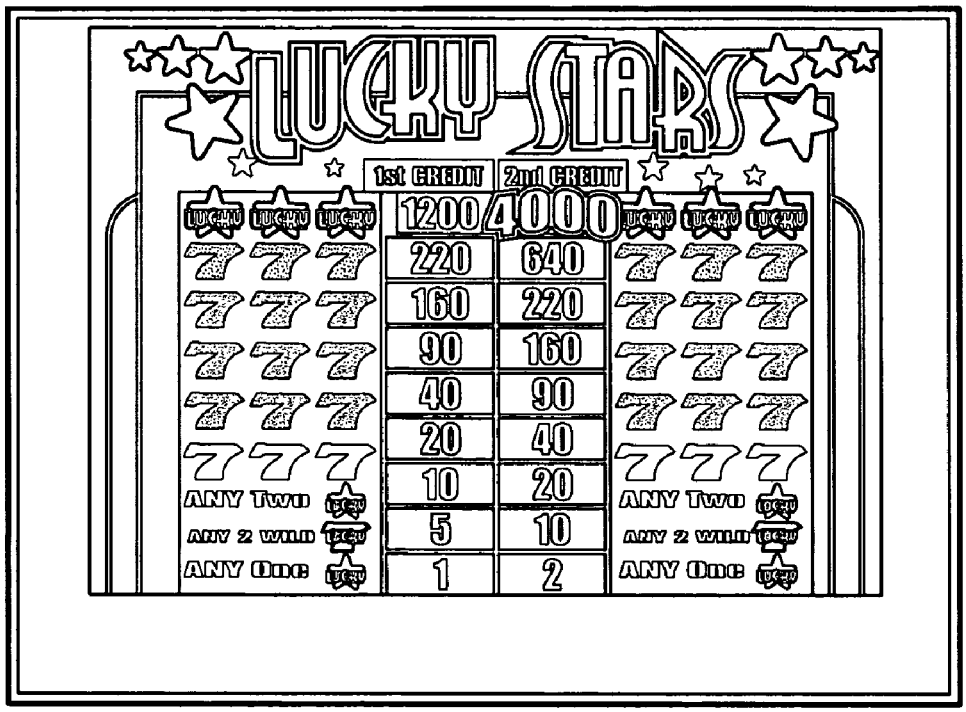
FIGS. 11*a* through 11*e* are display images associated with a "Lucky Stars" wagering gaming that may be conducted on the gaming machine.
Figure 11B:
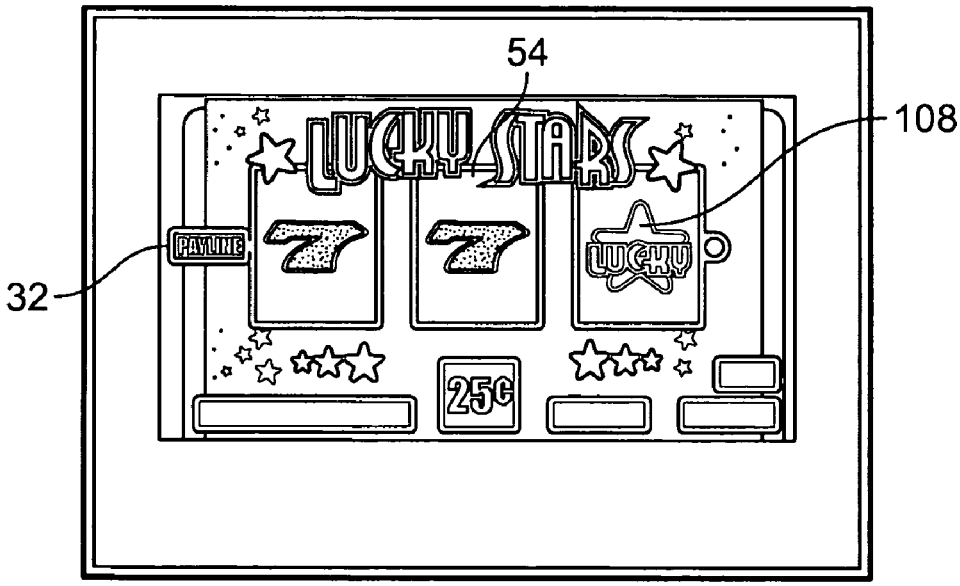
Figure 11D:
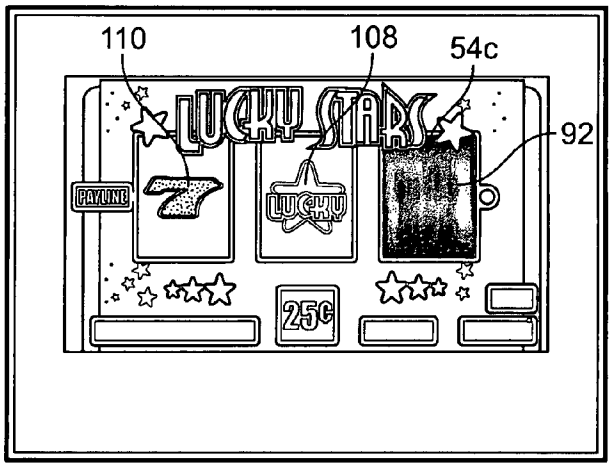
Figure 11C:
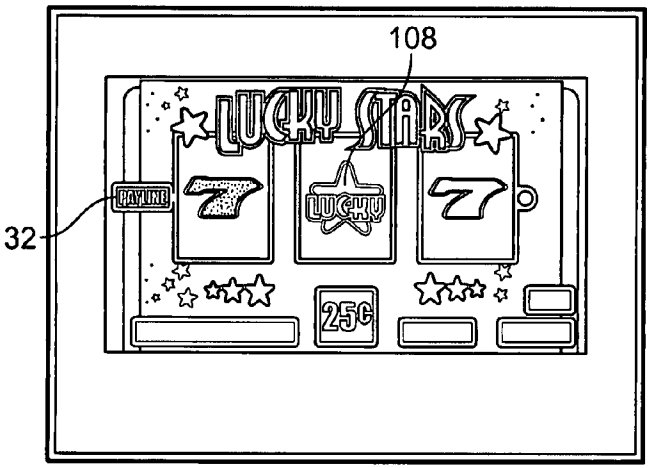
Figure 11E:
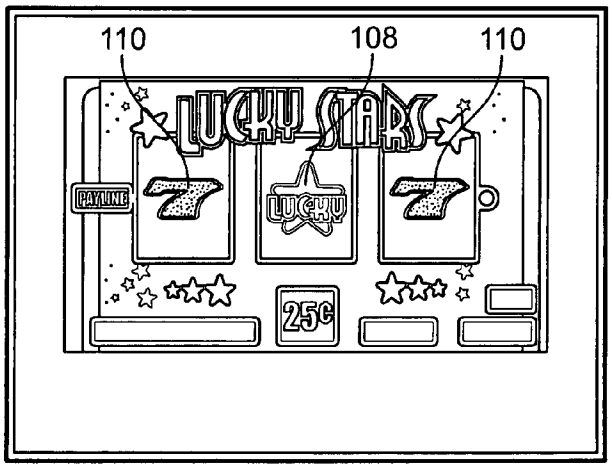

Referring to FIGS. 11*a* through 11*e*, a gaming machine conducts a wagering game called "Lucky Stars" in accordance with another embodiment of the present invention. FIG. 11*a* depicts the reel symbols and pay table for the game. FIG. 11*b* depicts a plurality of symbol-bearing reels 54 that may be mechanical or simulated in video. One of the reel symbols is a wild LUCKY STAR symbol 108 that matches or substitutes for all other reel symbols to complete a winning combination along a payline 32. In the illustrated example, the LUCKY STAR symbol 108 completes a RED SEVENS win. Referring to FIG. 11*c*, a "Lucky Stars" feature is triggered when the LUCKY STAR symbol 108 is used to complete a combination of mixed SEVENS on the payline 32, i.e. the LUCKY STAR symbol 108 and a pair of non-matching SEVEN symbols 110 and 112 land on the payline 32. Referring to FIGS. 11*d* and 11*e*, one of the two reels (e.g., reel 54*c*) carrying a SEVEN symbol on the payline 32 then respins to a SEVEN symbol 112 that matches the other SEVEN symbol 112, to complete a matching SEVENS win. The game may randomly choose which of the two reels displaying non-matching SEVENS is respun, or may always respin the reel displaying the SEVEN symbol of lesser value according to the pay table in FIG. 11*a*. The player is awarded for the matching SEVENS win.

Each of these embodiments and obvious variations thereof is contemplated as falling within the spirit and scope of the claimed invention, which is set forth in the following claims.

What is claimed is:

1. A gaming machine for conducting a wagering game, comprising:

a value input device for receiving a wager;

a plurality of primary positions for displaying respective primary symbols randomly selected from a plurality of possible primary symbols, the plurality of possible primary symbols including a special symbol; and a plurality of secondary positions for displaying respective secondary symbols, the secondary symbols including a modifier, each of the plurality of secondary positions being associated with a single one of the respective primary positions;

wherein in response to the displayed primary symbols including the special symbol, a controller is operative to modify (i) an award resulting from the primary symbols and is operative to modify (ii) a functionality of at least one of the primary symbols, based on the modifier displayed at the secondary position associated with the primary position of the special symbol.

2. The machine of claim 1, wherein the special symbol is a wild symbol that substitutes for other ones of the plurality of the possible primary symbols.

3. The machine of claim 1, wherein the modifier multiplies the award resulting from the primary symbols.

4. The machine of claim 1, wherein the plurality of secondary positions display respective modifiers for modifying at least one of the award and the functionality.

5. The machine of claim 1, wherein the controller is operative to randomly select the modifier.

6. The machine of claim 1, wherein the plurality of primary symbols are displayed on respective mechanical reels, and wherein the modifier is displayed on a video display.

7. A method of conducting a wagering game on a gaming machine, comprising:

receiving a wager;

displaying a plurality of randomly selected primary symbols at respective primary positions, the displayed primary symbols including a special symbol;

displaying a modifier at a secondary position associated with a single one of the primary positions, the single one of the primary positions including the special symbol, the secondary position being displayed separately from the primary symbol positions; and modifying, based on the modifier, at least one of (i) an award resulting from the primary symbols and (ii) a functionality of at least one of the primary symbols.

8. The method of claim 7, wherein the special symbol is a wild symbol that substitutes for other ones of the primary symbols.

9. The method of claim 7, wherein the modifier multiplies the award resulting from the primary symbols.

10. The method of claim 7, wherein the step of displaying a modifier includes displaying a plurality of modifiers at respective secondary positions associated with the respective primary positions, and wherein the modifying step modifies at least one of the award and the functionality based on the modifier displayed at the secondary position associated with the primary position of the special symbol.

11. The method of claim 7, wherein the modifier is randomly selected.

12. The method of claim 7, wherein the plurality of primary symbols are displayed on respective mechanical reels, and wherein the modifier is displayed on a video display.

13. The method of claim 7, further including providing a plurality of secondary positions associated with the respective primary positions, the plurality of secondary positions including the secondary position.

14. The method of claim 7, wherein the modifying step is responsive to the special symbol being one of the displayed primary symbols.

15. A non-transitory computer readable storage medium encoded with instructions for directing a gaming machine to perform the method of claim 7.

16. A method of conducting a wagering game on a gaming machine, comprising:

receiving a wager;

displaying a plurality of randomly selected primary symbols at respective primary positions, the displayed primary symbols including a special symbol;

displaying a plurality of secondary symbols at respective secondary positions, each of the plurality of secondary symbols being associated with a single one of the primary positions, the displayed secondary symbols including a duplicated special symbol at the secondary position associated with the primary position that contains the special symbol; and providing an award based on the primary symbols and the secondary symbols.

17. The method of claim 16, wherein the special symbol is a wild symbol that substitutes for other ones of the primary and secondary symbols.

18. The method of claim 16, wherein the plurality of primary symbols are displayed on a primary set of symbol-bearing reels, and the plurality of secondary symbols are displayed on a secondary set of symbol-bearing reels.

19. The method of claim 18, wherein one of the primary set and the secondary set is mechanical and the other of the primary set and the secondary set is simulated in video.

20. The method of claim 16, wherein the providing step includes providing a first award if the plurality of primary symbols form a winning outcome and multiplying the first award, if any, by a first award multiplier, and providing a second award if the plurality of secondary symbols form a winning outcome and multiplying the second award, if any, by a second award multiplier.

21. The method of claim 16, further including conducting a base game and triggering a bonus feature in response to a start-feature outcome in the base game, the bonus feature including the steps of displaying a plurality of randomly selected primary symbols, displaying a plurality of secondary symbols, and providing an award displaying steps.

22. A method of conducting a wagering game on a gaming machine, comprises:

providing a plurality of primary symbols at respective primary positions, the plurality of primary symbols including standard symbols and a wild symbol;

providing a plurality of secondary symbols at respective secondary positions, each of the plurality of secondary positions corresponding with a single one of the respective primary positions;

providing a pay table defining standard awards for respective winning combinations of symbols; and in response to the wild symbol being included in a first combination of the primary symbols, duplicating the wild symbol into a corresponding position of a second combination of the secondary symbols at respective secondary positions to increase a probability that the second combination of symbols is one of the winning combinations.

23. The method of claim 22, wherein if the wild symbol is used to complete one of the winning combinations, modifying the standard award for that winning combination.

* * * * *